United States Patent [19]

Schönwald et al.

[11] Patent Number: 4,657,487

[45] Date of Patent: Apr. 14, 1987

[54] VACUUM GENERATING APPARATUS INCLUDING LIQUID RING PUMP, PRE-SEPARATOR, TWO HEAT EXCHANGERS AND FINE SEPARATOR

[75] Inventors: Siegfried Schönwald; Norbert Schmid, both of Bad Neustadt; Hans-Georg Trojahn, Saal, all of Fed. Rep. of Germany

[73] Assignee: Siemens Aktiengesellschaft, Berlin and Munich, Fed. Rep. of Germany

[21] Appl. No.: 798,565

[22] Filed: Nov. 15, 1985

[30] Foreign Application Priority Data

Dec. 7, 1984 [DE] Fed. Rep. of Germany ..... 3444731

[51] Int. Cl.[4] ..... F04C 19/00; F04B 39/06; B01D 50/00

[52] U.S. Cl. ..... 417/68; 417/313; 417/372; 55/320; 55/350; 55/473; 55/482

[58] Field of Search ..... 417/68, 69, 313, 368, 417/372, 410; 418/DIG. 1, 83, 86, 101; 55/320, 350, 473, 482

[56] References Cited

U.S. PATENT DOCUMENTS

| | | | |
|---|---|---|---|
| 1,991,548 | 2/1935 | De Motte | 417/68 |
| 3,156,409 | 11/1964 | Paugh | 417/372 |
| 3,291,385 | 12/1966 | Williams et al. | 418/DIG. 1 X |
| 3,820,923 | 6/1974 | Zweifel | 418/DIG. 1 X |
| 4,083,659 | 4/1978 | Schmidt | 417/68 |
| 4,087,208 | 5/1978 | Uda et al. | 417/68 X |
| 4,257,749 | 3/1981 | Ramm | 417/68 |

FOREIGN PATENT DOCUMENTS

| | | | |
|---|---|---|---|
| 677399 | 6/1939 | Fed. Rep. of Germany | 418/86 |
| 1628327 | 12/1970 | Fed. Rep. of Germany | 418/DIG. 1 |
| 2636493 | 2/1978 | Fed. Rep. of Germany | 418/DIG. 1 |
| 2912938 | 10/1980 | Fed. Rep. of Germany | 417/68 |
| 3022147 | 1/1982 | Fed. Rep. of Germany | 417/68 |
| 1329699 | 9/1963 | France | 418/DIG. 1 |
| 1379378 | 4/1973 | United Kingdom | 417/68 |

OTHER PUBLICATIONS

Dipl.-Ing. Helmut Jansen, Öleingespritzte Kompressoren fü technisch ölfreie Luft, Oct. 1982, pp. 54–59.

*Primary Examiner*—Carlton R. Croyle
*Assistant Examiner*—Paul F. Neils
*Attorney, Agent, or Firm*—Kenyon & Kenyon

[57] ABSTRACT

A device for generating a vacuum comprises a liquid-ring vacuum pump driven by an electric motor and operating with a working fluid. A mixture of compressed air and working fluid from the pump flows to a preseparator which separates a major portion of the working fluid from the gaseous mixture. The separated working fluid is fed from a reservoir in the preseparator via a liquid cooling coil back to the liquid-ring vacuum pump, while the gas still loaded with a residue of the working fluid is fed to a fine separator by means of a gas cooler, working fluid separated in the fine separator being returned to the pump via a return line. The preseparator and the fine separator are physically spaced from one another. The gas cooler and the liquid cooling coil are also physically spaced from one another and are located in the path of the cooling air stream for the electric motor. The coolers are designed so that the gas from the preseparator is cooled to a substantially lower temperature than the temperature to which the working fluid is cooled in the liquid cooling coil.

14 Claims, 8 Drawing Figures

VACUUM GENERATING APPARATUS INCLUDING LIQUID RING PUMP, PRE-SEPARATOR, TWO HEAT EXCHANGERS AND FINE SEPARATOR

BACKGROUND OF THE INVENTION

This invention relates to an apparatus for generating a vacuum.

A vacuum pump such as a liquid-ring pump operates with a working fluid and is driven by an electric motor. The vacuum pump is followed by a preseparator which functions as a first stage for separating the working fluid from the gaseous mixture at the output of the liquid-ring pump. The working fluid separated out in the preseparator is fed via a liquid cooler back to the vacuum pump, while a gaseous component still loaded with a residue of the working fluid is fed to a fine separator at an output of the preseparator. A return line is connected between the fine separator and the liquid-ring pump for returning thereto fluid separated out in the fine separator.

Such as vacuum generating device is described in the journal "Fluid," October 1982, at page 58. In this device, the gaseous component leaving the preseparator is conducted over a fine filter which is disposed in a chamber adjacent to the preseparator.

It is known that the efficiency or effectiveness of the separation process depends to a high degree upon temperature, particularly when the working fluid is oil. A substantially better separation of the oil from the gas being pumped is achieved at lower oil temperatures.

Accordingly, in a compressed-air generator described in German Patent Document (Deutsche Offenlequncsschrift) No. 26 36 493, a cooler is arranged between the compressor and the preseparator for achieving a better separation of the working fluid (oil) from the compressed air: the gas-oil mixture leaving the compressor is cooled prior to arriving at the preseparator. In the process, the oil is cooled to relatively low temperatures, which requires a large heat exchanger or cooler.

It is to be noted tnat in a vacuum generating device, low temperatures of tne working fluid fed back into the vacuum pump are undesirable inasmuch as they cause condensation of the moisture contained in the intake air of the vacuum pump.

An object of the present invention is to provide an improved vacuum generating apparatus of the type generally described above.

Another, more particular, object of the present invention is to provide such a vacuum generating apparatus in which the degree of liquid separation is substantially improved by cooling and which there is little or no condensation of moisture within the pump and the preseparator from the gas being pumped.

Further object of tne present invention is to provide such a vacuum generating apparatus which has a minimum number of mechanical devices to achieve the separation and cooling.

Yet another object of the present invention is to provide such a vacuum generating apparatus which occupies a relatively small amount of space.

SUMMARY OF THE INVENTION

An apparatus for generating a vacuum comprises, in accordance with the present invention, a pump (e.g., a liquid-ring pump) utilizing a working fluid for pumping a gas from an enclosed space, a preseparator, two heat exchangers or coolers and a fine or auxiliary separator.

The pump is driven by a motor and has an output port through which a gaseous mixture of the working fluid and the gas passes during operation of the pump. The preseparator has an input coupled to the output port of the pump for separating the mixture transferred therefrom into a gaseous component and a liquid component, the gaseous component including particles of the gas being pumped and particles of the working fluid. A first of the two heat exchangers is operatively connected at an input to the preseparator for cooling the liquid component received therefrom to a first temperature, the first heat exchanger being coupled to the pumping means for delivering the cooled liquid component thereto. A second of the two heat exchangers is physically spaced from the first heat exchanger and connected at an input to the preseparator for cooling the gaseous component received therefrom to a second temperature lower than the first temperature. The fine separator is physically spaced from the preseparator and is connected at an input to the second heat exchanger for separating the gaseous component transferred therefrom into particles of the gas being separated and particles of the working fluid, the fine separator being connected to the pump for returning thereto the particles of the working fluid separated from the gaseous component by the fine separator.

In all pumping installations having separators for extracting the gas being pumped from the working fluid of a liquid-ring pump, the preseparator is heavily heated by the working fluid and the compressed gas. Owing to the physical separation of the two separators in accordance with the present invention, a thermal decoupling thereof is achieved, which increases the effectiveness of the separation process at the fine separator.

In accordance with the present invention, as set forth above, a separate heat exchanger is provided for cooling the liquid separated from the gaseous mixture by the preseparator. Because this heat exchanger is a separate unit, it can be designed to achieve an optimal operating temperature for the working fluid. Inasmuch as the separated liquid from the preseparator is to be cooled down to a relatively high temperature (the optimal operating temperature of the pump), the liquid cooler can be designed correspondingly small. The gas cooler, disposed between the preseparator and the fine separator, need extract only the small amounts of heat energy necessary for cooling the gaseous component produced by the preseparator. In addition, the gas cooler can be designed to cool the gaseous component down to an advantageously low temperature which facilitates a particularly fine separation of the gas particles and the working fluid particles in the fine separator.

In accordance with another feature of the present invention, a blower is provided for generating a stream of air and for pushing or pulling the stream of air past the drive motor of the pump to cool the motor. At least one, and preferably both, of the heat exchangers is disposed along the air stream generated by the blower. In this way, separate blowers for the liquid cooler and the gas cooler are avoided.

In accordance with further, more particular, features of the present invention, the first heat exchanger, i.e., the liquid cooler, takes the form of a coil of tubing at least partially wound about drive motor of the pump or positioned between the motor and the pump. This configuration of the liquid cooler provides the advantage of decreasing, if not minimizing, the amount of occupied space.

Pursuant to another feature of the present invention, the blower includes a blower hood with an inner casing wall and an outer casing wall spaced from one another to define a cooling chamber, this cooling chamber communicating with the preseparator for receiving the gaseous component therefrom. This arrangement further decreases the amount of space occupied by the vacuum generator. Preferably, the gas cooler is disposed upstream of the liquid cooler and of the drive motor in the air stream generated by the blower and is thereby acted upon by unheated air. The air stream passes the inside surface of the blower hood at a high velocity (approximately the circumferential velocity of the blower) and thereby effectuates a high degree of cooling. Moreover, despite the fact that the air stream is heated in the gas cooler and at the surface of the drive motor, the air stream can nevertheless remove sufficient heat from the liquid cooler since the working fluid need only be cooled to a temperature which is substantially higher than the temperature to which the gaseous component is cooled in the gas cooler.

Pursuant to yet another feature of the present invention, the blower hood is connected on one side via a first gas line to the preseparator and on an opposite side via a second gas line to the fine separator.

Pursuant to yet another feature of the present invention resulting in a further decrease in the space occupied by the vacuum generating apparatus, the drive motor has a longitudinal axis and the preseparator and the fine separator comprise respective tubular housing portions having respective longitudinal axes, the longitudinal axes of the tubular housing portions extending parallel to one another and to the longitudinal axis of the drive motor.

In addition, it is particularly advantageous if the pump is provided with an inlet pipe stub and an outlet pipe stub extending parallel to one another and perpendicularly with respect to a horizontal plane containing the longitudinal axis of the drive motor, the preseparator and the fine separator each being mounted above the drive motor to a respective one of the inlet pipe stub and the outlet pipe stub. More specifically, the preseparator is connected at an input opening to the outlet pipe stub by a branch pipe stub extending perpendicularly to the outlet pipe stub and parallel to the longitudinal axis of the drive motor, while the fine preseparator is connected to the inlet pipe stub. Such a configuration is particularly advantageous for a lateral disposition of the gas conduits extending from the preseparator to the blower hood. The gas conduits can be very short and simply connected to the separators and the blower hood of the gas cooler. Moreover, the separators, as well as the gas conduits, border the air stream produced by the blower and are partially cooled thereby. It is to be noted also that the same branch pipe stubs which serve to guide gaseous mixtures to and from the separators advantageously also serve to physically support the separators.

For design and servicing reasons it is advantageous if the preseparator and the fine separator each comprise a head portion to which connections are made and a body portion containing separator elements. A readily detachable coupling of the head portions and the respective body portions is attained if the body portions are each in the form of a cup having an open end provided with at least one outwardly extending bead and the head portions are each provided at one end with at least one outwardly extending bead, a fastener being engageable with the beads for locking the body portions of the preseparator and the separator to the respective head portions thereof.

In a particularly simple and advantageous design of the preseparator, a gas conduit extends substantially parallel to an upper wall of the body portion of the preseparator, the conduit terminating at an end of the body portion of the preseparator opposite the head portion thereof. A lower part of the body portion of the preseparator forms a reservoir for the liquid component upon separation thereof from the gaseous component, the reservoir communicating with the liquid cooler via an opening in the head portion of the preseparator.

In a particularly simple and advantageous design of the fine separator, a hollow filter surrounds and defines a substantially cylindrical chamber communicating with the gas cooler via a gas supply opening in the head portion of the fine separator. With this design, no further line elements for the gas are necessary between the supply opening of the head portion of the fine separator and the filter in the body portion thereof.

In accordance with another feature of the present invention, the lower part of the body portion of the fine separator forms a reservoir for the particles of the working fluid separated out from the gaseous component by the fine separator, the head portion of the fine separator being provided with a bore located below an upper surface of the reservoir, the bore communicating with the inlet pipe stub. By this construction, a return of the working fluid collected in the fine separator is possible without a separate return line. If, on the other hand, a return line is provided, it advantageously opens into the inlet stub of the pump or into the section of the pump between the inlet and outlet stubs. Owing to the higher pressure prevailing in the body portion of the fine separator opposite the opening into the vacuum pump, the working fluid separated out in the fine separator is transported to the pump in both cases. In the event a separate return line is used, it is possible to provide a condensate separator therein. In this separator, condensates possibly contained in the working fluid are separated therefrom. By means of a separate return line, the working fluid can be introduced into the working space of the pump at a point where the suction process is completed. The intake volume stream is then influenced only to a small extent by the re-evaporating condensate. In such a case a separate condensate separator becomes unnecessary because condensate is accummulated only occasionally and to a limited extent.

A return of working fluid collected in the blower hood is achieved without a special conveyor device by providing a discharge line of small cross-section connected to the blower hood at the lowest point thereof and to the fine separator at a point above the level of the working fluid reservoir contained therein. During the flow of the gaseous component through the cylindrical filter in the fine separator, a pressure gradiant arises between the spaces on the inside and the outside of the filter, which pressure gradiant is effective to draw working fluid up the discharge line from the base of the blower hood to the fine separator.

DETAILED DESCRIPTION

Figure 1:
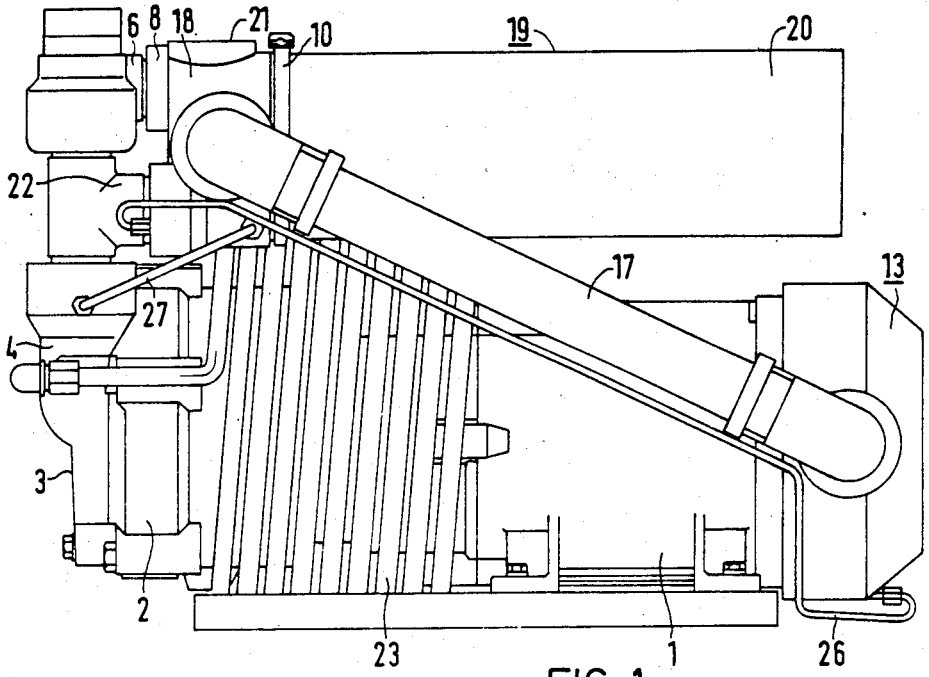
FIG. 1 is a side elevational view of an apparatus for generating a vacuum, showing a blower hood, a preseparator and a fine separator, in accordance with the present invention.
Figure 2:
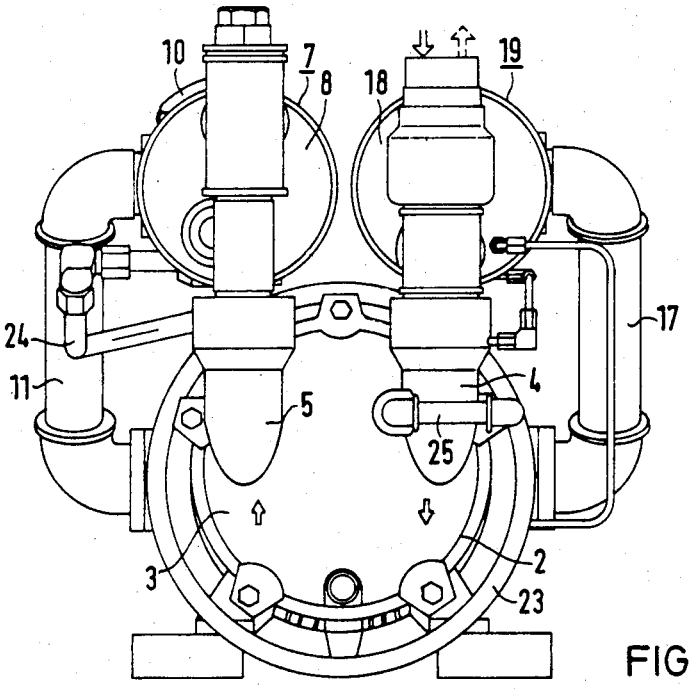
FIG. 2 is a front elevational view of the vacuum generating apparatus illustrated in FIG. 1.
Figure 4:
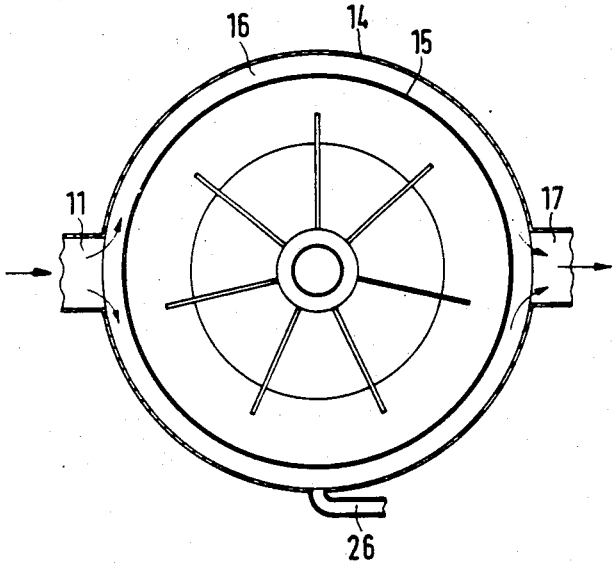
FIG. 4 is a transverse cross-sectional view taken along line IV—IV in FIG. 3.
Figure 3:
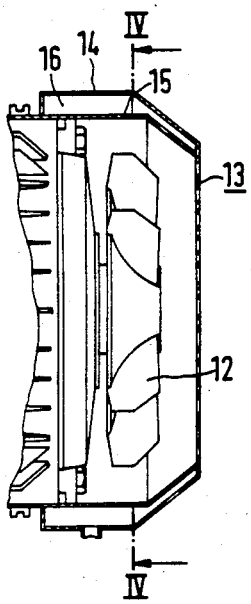
FIG. 3 is a longitudinal cross-sectional view of the blower hood shown in FIG. 1.

As illustrated in FIGS. 1 and 2, a vacuum generating apparatus in accordance with the present invention, comprises an electric motor 1 operatively connected to a liquid-ring pump 2. Liquid-ring pump 2 has a housing cover to which are connected an inlet pump stub 4 and an outlet pipe stub 5 each having a vertical orientation.

A preseparator 7 is connected to the outlet or discharge pipe stub 5 by means of a horizontally extending branch pipe stub 6. Preseparator 7 has a head portion 8 provided with openings for the connection of input and output pipe lines to the preseparator and a vessel or body portion 9 containing the separator elements. Head portion 8 and body portion 9 are detachably fastened to one another by means of a clamping lock 10.

A gas line or conduit 11 extends from head portion 8 of preseparator 7 to a blower hood 13 which surrounds a blower 12 for sending a stream of cooling air past electric motor 1. Blower hood 13 forms a gas cooler or heat exchanger and includes a substantially annular outer wall 14 and a substantially annular inner wall 15 coaxial with one another. Outer wall 14 is radially spaced from inner wall 15 to form a substantially cylindrical cooling chamber 16 which communicates with preseparator 7 via gas conduit 11.

Gas which has been cooled in heat exchanger or blower hood 13 is conducted to a head portion 18 of a fine separator 19 via an additional gas line or conduit 17 connected laterally to the outer wall 14 of blower hood 13.

In addition to head portion 18, fine separator 19 includes a vessel part or body portion 20 connected to the head portion by means of a clamping lock 10'. A discharge opening 21 for the separated gas particles is provided in head portion 18 of fine separator 19. Head portion 18 itself is screwed onto a branch pipe stub 22 connected to and supported by inlet pipe stub 4. Like pipe stub 6, pipe stub 22 extends horizontally parallel to a longitudinal axis of drive motor 1.

A liquid cooler or heat exchanger 23 in the form of a coil of tubing is positioned between electric motor 1 and the housing of liquid-ring pump 2 coaxially with the housing of electric motor 1. Liquid cooling coil 23 is connected at an input end 24 (FIG. 2) to head portion 8 of preseparator 7 and can extend more or less over the length of the motor housing. The other end 25 of liquid cooling coil 23 is coupled either to inlet pipe stub 4 or to the section of the liquid-ring pump between the openings of the inlet pipe stub 4 and the outlet pipe stub 5.

A discharge line or conduit is connected at one end to the lowermost point of the blower hood or air cooler 13 and at an opposite end to fine separator 19 at a point above the surface of a working fluid reservoir 33' contained in a lower part of the body portion of the fine separator. A return line 27 is connected to a discharge hole 43 of head portion 18 of fine separator 19 and extends to intake or inlet stub 4 of liquid-ring pump 2.

Figure 5:
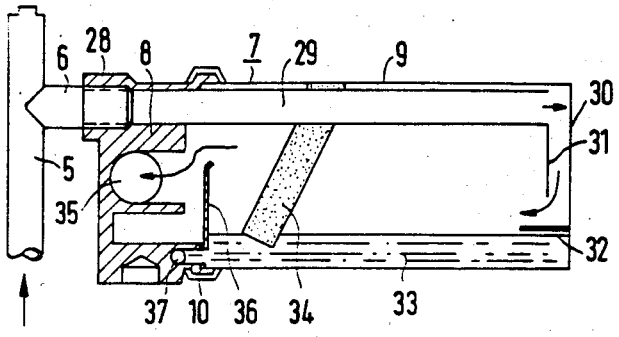
FIG. 5 is a schematic longitudinal cross-sectional view of the preseparator shown in FIG. 1.
Figure 6:
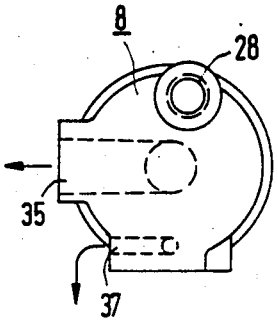
FIG. 6 is a front view of the preseparator shown in FIG. 5, taken from the left side in that drawing figure.

As illustrated in FIGS. 5 and 6, head portion 8 of preseparator 7 is provided with an inlet opening 28 having an internal screw thread mating with an external screw thread of branch pipe stub 6. Inside head portion 8, a gas guide line or conduit 29 is connected to entrance hole 28. Gas guide conduit 29 extends longitudinally parallel to the upper wall of body portion 9 and terminates near an end 30 of body portion 9 opposite head portion 8. At the free end of gas conduit 29 is provided a downwardly extending shield or guide plate 31, while at the bottom of body portion 9 is provided a horizontally extending deflector or baffle 32 connected to end wall 30 of body portion 9.

Gas which is leaving conduit 29 at the free end thereof is loaded with working fluid and is deflected through two 90° turns by end wall 30, shield 31 and deflector 32. In the deflection process, a large portion of the working fluid is separated from the gaseous mixture conducted from outlet pipe 5 through branch pipe 6 and conduit 29. The separated working fluid is collected in a reservoir 33 at the bottom of body portion 9 of preseparator 7. A further part of the working fluid is separated from the gaseous mixture by a separation filter 34 arranged substantially transversely in body portion 9 of preseparator 7. On a downstream side of separation filter 34, a gaseous component or mixture, comprising the gas being pumped and further unseparated particles of the working fluid, flows around a partition 36, which effectuates further separation, and towards a discharge port 35. Below the surface of the liquid reservoir 33 in body portion 9 of preseparator 7, a discharge opening is provided, to which the one end 24 of liquid cooling coil 23 is connected.

Figure 8:
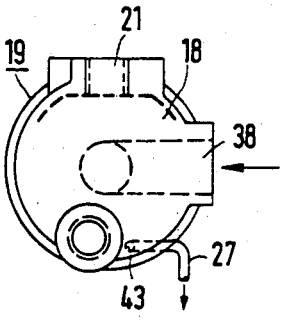
FIG. 8 is a front elevational view of the fine separator shown in FIG. 7, taken from the right side of that drawing figure.
Figure 7:
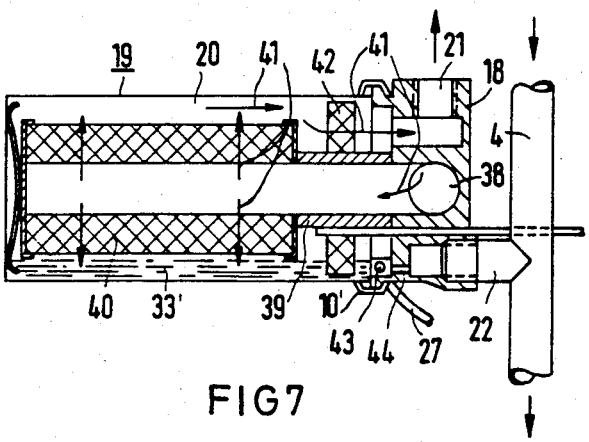
FIG. 7 is a partially schematic longitudinal cross-sectional view of the fine separator shown in FIG. 1.

As illustrated in FIGS. 7 and 8, head portion 18 of fine separator 19 is provided with a gas supply opening 38 at which the outlet end of gas conduit 17 is connected to head portion 18. A pipe 39 connects the gas supply opening 38 to a cylindrical inner space defined by a cylindrical filter 40 disposed in body portion 20 of separator 19. As indicated by arrows 41, the gaseous mixture or component which has been cooled by heat exchanger or blower hood 13 and transported to separator 19 enters the separator via gas supply opening 38, flows through pipe 39 into the interior of cylindrical filter 40, and then flows through the filter. Because the gas is cooled in the blower hood 13 to a relatively low temperature, a high degree of separation is achieved in filter 40. After flowing through filter 40, the separated gas particles pass through a subsequent filter 42 and leave fine separator 19 via outlet opening 21.

Below the surface of a fluid reservoir 33' located in a lower part of body portion 20 of fine separator 19, a discharge opening 43 is provided to which return line 27 is connected.

Instead of discharge hole 43, head portion 18 of fine separator 19 may be provided with a bore 44 extending to and communicating with a horizontally extending branch pipe stub 22 connected to inlet pipe stub 4 and supporting fine separator 19. Working fluid from reservoir 33' flows into pipe stube 22 and from there into inlet stub 4 to the liquid-ring pump 2. Return line 27 must be provided if, prior to the return of working fluid from reservoir 33' to liquid-ring pump 2, condensate present in the working fluid in separator 19 is separated by means of a condensate separator or if the working fluid from reservoir 33' is to be reintroduced into liquid-ring pump 2 at point between the opening of inlet pipe stub 4 and outlet pipe stub 5 into liquid-ring pump 2.

Preferably, head portions 8 and 18 of preseparator 7 and fine separator 19 have the same shape and size. During manufacture, it is only necessary, therefore, to provide the appropriate openings in the respective head portions for the input and output connections to the separators 7 and 19. Accordingly, only entrance hole or opening 28 and discharge opening 35 need be made in the head portion 8 of preseparator 7, while discharge opening 21 and discharge hole 43 or hole 44 must be made in the head portion 18 of fine separator 19.

During operation of a vacuum generating apparatus as illustrated in the drawing, air is drawn in via inlet stub 4 from a space in which a vacuum is to be generated. In the liquid-ring pump 2, the air is compressed and ejected, together with part of the working fluid present in the liquid-ring pump, into preseparator 7 via outlet stub 5 and branch stub 6 connected thereto. In preseparator 7, a major portion of the working fluid is separated from the air-liquid mixture entering the preseparator from the liquid-ring pump.

Working fluid accumulated in reservoir 33 of preseparator 7 is transported, under the pressure prevailing in the preseparator, through liquid cooling coil 23 and is cooled down therein by a predetermined temperature drop. From liquid cooling coil 23, working fluid flows back into inlet stub 4 or into the section between the inlet and outlet openings of the liquid-ring pump. The liquid cooling coil 23 is designed so that working fluid is cooled only by a relatively small temperature difference and leaves the coil at a temperature most advantageous for the operation of liquid-ring pump 2.

Air which accumulates in preseparator 7 and is still loaded with a residue of the working fluid leaves preseparator 7 via discharge hole 35 and flows via gas conduit 11 into blower hood 13. The cooled air-liquid mixture then flows to fine separator 19 from blower hood 13 via conduit 17.

While flowing through cooling space 16 of blower hood 13, the air-liquid mixture is cooled down to a temperature which is substantially lower, i.e., by more than 10° C., than the temperature of the working fluid leaving the liquid cooling coil 23. Because of the low temperature of the air-liquid mixture, condensation of the working fluid vapors still present in the air sets in, whereby separation of the working fluid particles by filter 40 of fine separator 19 is aided.

After flowing through filter 40, the air (substantially free of working fluid particles) leaves fine separator 19 through exit opening 21 thereof. Working fluid in reservoir 33' is returned to liquid-ring pump 2 via discharge hole 43 and return line 27, or via hole 44 and lateral pipe stub 22.

By cooling the gas in blower hood 13, some of the working fluid is condensed and accumulated at the lowest point of the blower hood. From that point, the working fluid is transported into fine separator 19 via discharge line 26. Because discharge line 26 opens behind filter 40 in fine separator 19, a pressure difference which exists between the point of connection of the discharge line to the blower hood 13 and the point of connection of the discharge line to the fine separator is sufficient to transport the working fluid from the blower hood 13 to fine separator 19. Owing to this configuration of discharge line 26, a separate mechanism for transporting the working fluid from the blower hood is unnecessary.

For operating liquid cooling coil 23 at a temperature level substantially higher than the temperature level of gas cooler or blower hood 13, the use of a liquid-ring pump 2 as the vacuum pump is particularly advantageous. In such a pump, a relatively large amount of working fluid is ejected together with the compressed gas. Accordingly, a relatively large amount of liquid is available for removing or dissipating the heat accumulated in the pump, a relatively small temperature drop of the working fluid in the cooling coil 23 being sufficient to transfer heat from the liquid-ring pump to the external atmosphere. Because the compressed gas from the preseparator has a relatively small mass in comparison with the separated working fluid, only a small portion of the dissipation heat can be removed by cooling the gas. In addition, only a small gas cooler, i.e., the blower hood 13, is required for cooling the mass of the air. Gas cooler or blower hood 13 is designed so that the gas is cooled down to a temperature considerably lower than the temperature to which the working fluid is cooled in cooling coil 23.

By the separate cooling of the working fluid and the gas, the respective heat exchangers or coolers 23 and 13 can be designed for the required cooling in each case. The separate coolers leads to an overall lower cost for the vacuum generating system.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the descriptions and illustrations herein are proffered to facilitate comprehension of the invention and should not be construed to limit the scope thereof.

What is claimed is:

1. An apparatus for generating vacuum, comprising:

pumping means including a liquid-ring pump utilizing a liquid for pumping a gas from an enclosed space, said pumping means having an output port through which a gaseous mixture of said liquid and said gas passes during operation of said pumping means;

motor means including an electric drive motor operatively connected to said pumping means for driving same;

preseparation means having an input coupled to said output port of said pumping means for separating said mixture into a gaseous component and a liquid component, said gaseous component including particles of said gas and particles of said liquid;

first heat exchange means operatively connected at an input to said preseparation means for cooling said liquid component to a first temperature upon receiving said liquid component from said preseparation means, said first heat exchange means being coupled to said pumping means for delivering the cooled liquid component thereto;

second heat exhange means physically spaced from said first heat exchange means and connected at an input to said preseparation means for cooling said gaseous component to a second temperature lower than said first temperature;

fine separation means physically spaced from said preseparation means and connected at an input to said second heat exchange means for separating said gaseous component into particles of said gas and particles of said liquid upon cooling of said gaseous component by said second heat exchange means, said fine separation means being connected to said pumping means for returning thereto the particles of said liquid separated from said gaseous component by said fine separation means; and air stream means for generating a stream of air and for passing said stream of air by said motor means to cool same, at least one of said first and said second heat exchange means being disposed along the stream of air generated by said air stream means, said air means including a blower with a blower hood and said second heat exchange means including an inner casing wall and an outer casing wall formed as portions of said blower hood, said inner casing wall and said outer casing wall being spaced from one another to define a cooling chamber, said cooling chamber communicating with said preseparation means for receiving said gaseous component therefrom.

2. An apparatus in accordance with claim 1 wherein said blower hood is connected on one side via a first gas line to said preseparation means and on an opposite side via a second gas line to said fine separation means.

3. An apparatus in accordance with claim 1 wherein said first heat exchange means takes the form of a coil of tubing.

4. An apparatus in accordance with claim 3 wherein said coil of tubing is at least partially wound about said motor means.

5. An apparatus in accordance with claim 1 wherein said motor means has a longitudinal axis, said pumping means being provided with an inlet pipe stub and an outlet pipe stub extending parallel to one another and perpendicularly with respect to a horizontal plane containing the longitudinal axis of said motor means, said preseparation means and said fine separation means each mounted to a respective one of said inlet pipe stub and said outlet pipe stub.

6. An apparatus in accordance with claim 5 wherein said preseparation means is connected at an input opening to said outlet pipe stub by a branch pipe stub extending perpendicularly to said outlet pipe stub and parallel to the longitudinal axis of said motor means, said output port of said pumping means being located at an end of said branch pipe stub opposite said outlet pipe stub, said fine separation means being connected to said inlet pipe stub.

7. An apparatus in accordance with claim 6 wherein said preseparation means and said fine separation means each comprise a head portion to which connections are made and a body portion containing separator elements.

8. An apparatus in accordance with claim 7 wherein said preseparation means includes a gas conduit extending substantially parallel to an upper wall of the body portion of said preseparation means, said conduit terminating at an end of the body portion of said preseparation means opposite the head portion thereof, a lower part of the body portion of said preseparation means forming a reservoir for said liquid component upon separation thereof from said gaseous component, said reservoir communicating with said first heat exchange means via an opening in the head portion of said preseparation means.

9. An apparatus in accordance with claim 7 wherein the head portions of said preseparation means and said fine separation means have substantially the same size and shape and wherein the body portions of said preseparation means and said fine separation means have substantially the same size and shape.

10. An apparatus in accordance with claim 9 wherein the body portions of said preseparation means and said separation means are each in the form of a cup having an open end provided with at least one outwardly extending bead, the head portions of said preseparation means and said fine separation means each being provided at one end with at least one outwardly extending bead, further comprising fastening means engageable with said beads for locking the body portions of said preseparation means and said fine separation means to the respective head portions thereof.

11. An apparatus in accordance with claim 7 wherein said fine separation means includes a hollow filter surrounding and defining a substantially cylindrical chamber, said cylindrical chamber communicating with said second heat exchange means via a gas supply opening in the head portion of said fine separation means.

12. An apparatus in accordance with claim 11 wherein a lower part of the body portion of said fine separation means forms a reservoir for the particles of said liquid separated out from said gaseous component by said fine separation means, the head portion of said fine separation means being provided with a bore located below an upper surface of said reservoir, said bore communicating with said inlet pipe stub.

13. An apparatus in accordance with claim 11, further comprising conduit means, including a return line extending from said fine separation means to said inlet pipe stub, for returning the separated particles of said liquid from said fine separation means to said pumping means.

14. An apparatus in accordance with claim 11 wherein said air stream means includes a blower with a blower hood and wherein said second heat exchange means includes an inner casing wall and an outer casing wall formed as portions of said blower hood, said inner casing wall and said outer casing wall being spaced from one another to define a cooling chamber, said cooling chamber communicating with said preseparation means for receiving said gaseous component therefrom, a lower part of the body portion of said fine separation means forming a reservoir for the particles of said liquid separated out from said gaseous component by said fine separation means, further comprising conduit means, including a line of small cross-section extending from substantially a lowermost portion of said blower hood to said fine separation means at a location thereon above an upper surface of said reservoir, for transferring separated liquid from said cooling chamber to said reservoir.

* * * * *